US007486922B2

(12) United States Patent
Nakano et al.

(10) Patent No.: US 7,486,922 B2
(45) Date of Patent: Feb. 3, 2009

(54) FIXING DEVICE AND IMAGE FORMING APPARATUS WITH SEPARATING MECHANISM PIVOTABLE ABOUT PLURAL AXES

(75) Inventors: Kuniaki Nakano, Osaka (JP); Yoshiharu Kanematsu, Osaka (JP); Shinichi Uchida, Osaka (JP)

(73) Assignee: Kyocera Mita Corporation (JP)

( * ) Notice: Subject to any disclaimer, the term of this patent is extended or adjusted under 35 U.S.C. 154(b) by 56 days.

(21) Appl. No.: 11/602,756

(22) Filed: Nov. 21, 2006

(65) Prior Publication Data

US 2007/0116498 A1 May 24, 2007

(30) Foreign Application Priority Data

Nov. 22, 2005 (JP) ..... 2005-337403
Nov. 29, 2005 (JP) ..... 2005-343243
May 22, 2006 (JP) ..... 2006-141416

(51) Int. Cl.
*G03G 15/20* (2006.01)

(52) U.S. Cl. ..... 399/323; 399/320; 399/399; 271/311

(58) Field of Classification Search ..... 399/322, 399/323, 399, 122; 271/307, 311
See application file for complete search history.

(56) References Cited

U.S. PATENT DOCUMENTS 3,940,946 A * 3/1976 Andersen ..... 464/89
4,408,757 A * 10/1983 Yarm ..... 271/311
4,475,804 A * 10/1984 Kanno et al. ..... 399/323
5,069,569 A * 12/1991 Lieser ..... 403/57
5,517,292 A 5/1996 Yajima et al.
5,528,791 A * 6/1996 Wilson ..... 15/119.2
5,802,434 A 9/1998 Takehara et al.
6,152,640 A * 11/2000 Oda et al. ..... 403/133

FOREIGN PATENT DOCUMENTS

JP 2004-157481 3/2004

* cited by examiner

*Primary Examiner*—David M Gray
*Assistant Examiner*—G. M. Hyder
(74) *Attorney, Agent, or Firm*—Gerald E. Hespos; Anthony J. Casella

(57) ABSTRACT

A fixing device is provided with a fixing roller for fixing a toner image transferred on a sheet to the sheet, and a separating mechanism for separating the sheet from the fixing roller. The separating mechanism includes a claw member having a tip portion held in contact with the outer circumferential surface of the fixing roller for separating the sheet from the fixing roller, a supporting member pivotably supporting the claw member, and a biasing member for biasing the claw member toward the outer circumferential surface of the fixing roller so that the tip portion of the claw member presses the fixing roller.

15 Claims, 13 Drawing Sheets

FIXING DEVICE AND IMAGE FORMING APPARATUS WITH SEPARATING MECHANISM PIVOTABLE ABOUT PLURAL AXES

BACKGROUND OF THE INVENTION

1. Field of the Invention

The present invention relates to a fixing device for fixing a toner image transferred on a sheet to the sheet and an image forming apparatus employing such a fixing device.

2. Description of the Background Art

There has been conventionally known a fixing device used in an image forming apparatus such as a printer or copier for fixing a toner image transferred on a sheet to the sheet. In such a fixing device, elastic layers (rubber layers) have been provided on a pressure(pressing) roller and a fixing (heating) roller, and means for separating a sheet from the outer circumferential surface of the fixing roller by the shape of a nip between the pressure roller and the fixing roller has been used.

However, if the fixing roller is provided with the elastic layer, problems such as a reduction in temperature following capability when sheets are successively fed and an increase in warm-up time arise due to a lower heat conductivity of the elastic layer. Thus, it has been difficult to sufficiently cope with a recent energy-saving tendency. Further, a technology of fixing a toner image to a sheet using a belt has been proposed and commercialized, but has problems of a complicated construction and an increased cost.

On the other hand, there has been known a fixing device using, as a fixing roller, a so-called hard roller constructed by covering the outer circumferential surface of an aluminum or iron core with a fluorocarbon-resin coating or tube. The warm-up time can be sufficiently shortened due to a high heat conductivity of the fixing roller in this fixing device and it is possible to inexpensively construct the fixing device.

However, since a large adhesive force is created between the fixing roller and the sheet where a large amount of molten toner is present if the above fixing roller (hard roller) is used, it is necessary to use means for forcibly separating the sheet from the outer circumferential surface of the fixing roller by bringing a separating claw into contact with the fixing roller. Therefore, there has been a problem of the abrasion of the fixing roller in the case of repeated use.

Accordingly, in order to suppress the abrasion of the fixing roller by the separating claw, a technology of reducing a contact pressure of the separating claw with the fixing roller by widening the width of the leading end of the separating claw has been proposed, for example, in Japanese Unexamined Patent Publication No. 2004-157481. This publication discloses a fixing device constructed such that a separating claw rotatable about one axial direction (direction of the central axis of a fixing roller) is held in contact with the outer circumferential surface of the fixing roller using a spring.

However, according to such a method for bringing the separating claw into contact with the fixing roller, the separating claw and the fixing roller are substantially in point contact with each other if one side of the leading end of the separating claw is held in contact with the outer circumferential surface of the fixing roller due to dimensional tolerance and the like of components. Thus, a contact pressure of the separating claw with the fixing roller concentrates on this contact point and an effect of widening the width of the leading end of the separating claw cannot be sufficiently obtained, thereby causing a problem of making it difficult to sufficiently suppress the abrasion of the fixing roller. As a result, lines are formed on an image due to the abrasion marking of the fixing roller. Particularly, in a color image forming apparatus, there is a problem of considerable image deterioration.

SUMMARY OF THE INVENTION

An object of the present invention is to solve problems as above and to provide a fixing device capable of suppressing an occurrence of image deterioration and an image forming apparatus employing such a fixing device.

In order to accomplish the above object, one aspect of the present invention is directed to a fixing device, comprising a fixing roller for fixing a toner image transferred on a sheet to the sheet; and a separating mechanism for separating the sheet from the fixing roller; the separating mechanism including a claw member having a tip portion held in contact with the outer circumferential surface of the fixing roller for separating the sheet from the fixing roller, a supporting member pivotably supporting the claw member, and a biasing member for biasing the claw member toward the outer circumferential surface of the fixing roller so that the tip portion of the claw member presses the fixing roller.

Another aspect of the present invention is directed to an image forming apparatus comprising an image forming unit for transferring a toner image to a sheet and a fixing device for fixing the toner image transferred in the image forming unit to the sheet by heating, the fixing device having the above construction.

These and other objects, features, aspects and advantages of the present invention will become more apparent upon a reading of the following detailed description and accompanying drawings.

BRIEF DESCRIPTION OF THE DRAWINGS

FIGS. 11A to 11C are plan views showing an exploded state of the separating mechanism of the second fixing device, wherein FIG. 11A shows a part of a housing of the second fixing device, FIG. 11B shows a separating claw unit and coil springs, and FIG. 11C shows a supporting member.

FIGS. 12A to 12C are front views showing an exploded state of the separating mechanism of the second fixing device, wherein FIG. 12A shows the part of the housing of the second fixing device, FIG. 12B shows the separating claw unit and the coil springs, and FIG. 12C shows the supporting member.

FIGS. 13A to 13C are side views showing an exploded state of the separating mechanism of the second fixing device, wherein FIG. 13A shows the part of the housing of the second fixing device, FIG. 13B shows the separating claw unit and the coil springs, and FIG. 13C shows the supporting member.

DETAILED DESCRIPTION OF THE PREFERRED EMBODIMENTS

Hereinafter, embodiments of the present invention are described with reference to the accompanying drawings.

Figure 1:
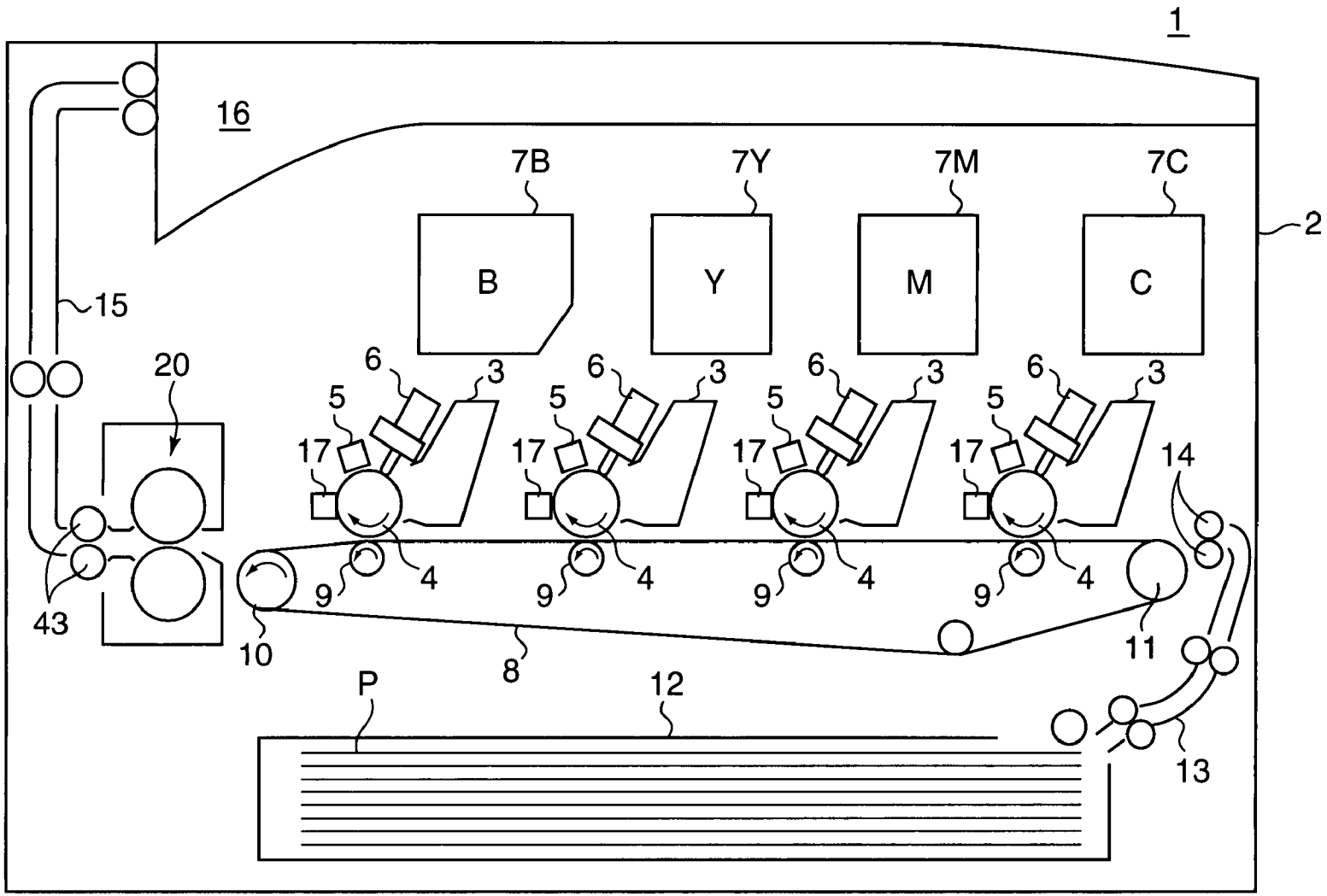
FIG. 1 is a front view in section showing an entire construction of a printer including a fixing device according to an embodiment of the invention.
Figure 2:
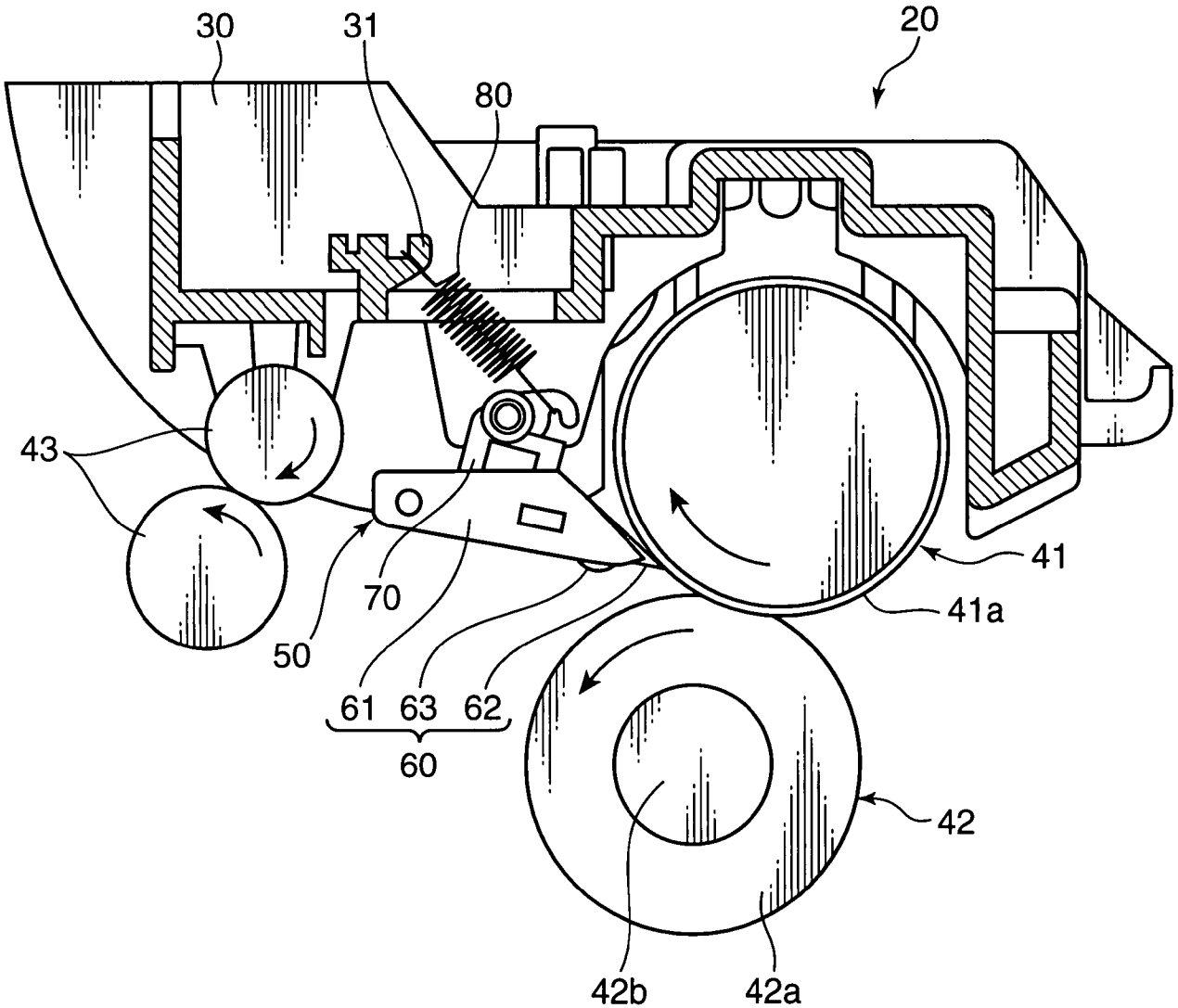
FIG. 2 is a front view of a first fixing device of the embodiment shown in FIG. 1.

FIG. 1 is a front view in section showing the entire construction of a printer 1 including a fixing device 20 according to one embodiment of the present invention, and FIG. 2 is a front view showing the construction of the fixing device 20 shown in FIG. 1. Further, FIGS. 3 to 7 are views showing the construction of a separating mechanism of the fixing device 20 shown in FIG. 2. First with reference to FIG. 1, the entire construction of the printer 1 including the fixing device 20 according to the first embodiment of the present invention is described.

As shown in FIG. 1, in this printer 1, a developing device 3 is provided for each of colors: cyan (C), magenta (M), yellow (Y) and black (B) in a printer main body 2. Each developing device 3 includes a photoconductive drum 4 made of, e.g. a-Si (amorphous silicon) and rotatable in a direction of arrow in FIG. 1.

These photoconductive drums 4 are uniformly charged by chargers 5 and exposing devices (LED print head units) expose the outer circumferential surfaces of the photoconductive drums 4 with LED lights based on document image data inputted from an external PC (personal computer) or the like, thereby forming electrostatic latent images, to which toners are attached to form toner images. These toners are supplied from toner supply containers 7C, 7M, 7Y and 7B.

A conveyance belt 8 is disposed below the juxtaposed photoconductive drums 4 for the respective colors. The conveyance belt 8 is pressed against the respective photoconductive drums 4 by transfer rollers 9, and is turned in a rotating direction of the photoconductive drums 4 by a drive roller 10 driven by an unillustrated motor or the like and a driven roller 11 rotated as the conveyance belt 8 is endlessly turned by the drive roller 10.

The sheet P is conveyed from a sheet feeding unit 12 toward the conveyance belt 8 via a sheet conveyance path 13, wherein timings of an image transferring operation by the respective photoconductive drums 4, the transfer rollers 9 and the like and a sheet feeding operation are adjusted by a pair of registration rollers 14. After the timing adjustment, the pair of registration rollers 14 are rotated to convey the sheet P to between the photoconductive drums 4 and the conveyance belt 8. While the sheet P is conveyed between the respective photoconductive drums 4 and the conveyance belt 8, the toner images on the outer circumferential surface of the respective photoconductive drums 4 are successively transferred to the sheet P.

A sheet P having the toner images transferred thereon by all the photoconductive drums 4 is conveyed to the fixing device 20 to have the toner images fixed, whereby a color image is formed. The sheet P having passed the fixing device 20 is discharged to a discharging section 16 via a sheet conveyance path 15. It should be noted that each of the above photoconductive drums 4 is provided with a cleaning device 17 for removing residual toner and the like on the photoconductive drum 4.

Next, with reference to FIGS. 2 to 7, the construction of the fixing device 20 is described in detail. As shown in FIG. 2, the fixing device 20 is constructed such that a fixing (heating) roller 41 capable of evolving heat and a pressure (pressing) roller 42 disposed below the fixing roller 41 to have the outer circumferential surface thereof face that of the fixing roller 41 are arranged in a housing 30 as an apparatus main body. The sheet P after the image transferring operation (see FIG. 1) is heated by the fixing roller 41 to fix the toner image fixed thereto by passing a nip area between the fixing roller 41 rotating clockwise and the pressure roller 42 driven to rotate counterclockwise.

This fixing roller 41 is comprised of an outer tubular element 41*a* formed by coating the outer circumferential surface of a metallic tubular element with a specified material, and a halogen lamp or a like heat source (not shown) mounted in the outer tubular element 41*a*. An unillustrated ring gear is fixed to one end of this outer tubular element 41*a*. The driving rotation of a motor (not shown) disposed at a specified position outside the housing 30 is transmitted to the ring gear via a gear mechanism or the like, whereby the outer tubular element 41*a* is drivingly rotated about a central axis thereof.

The pressure roller 42 is comprised of a tubular roller main body 42*a*, and a roller shaft 42*b* arranged concentrically with the roller main body 42*a* and penetrating end walls of the roller main body 42*a*. This pressure roller 42 is pressed against the outer circumferential surface of the outer tubular element 41*a* of the fixing roller 41 in the nip area, thereby being driven to rotate by the fixing roller 41.

In the fixing device 20, a plurality of (four in this embodiment) separating mechanisms 50 are arranged at specified intervals along a direction of the longitudinal axis of the fixing roller 41 at a specified part of the housing 30. A pair of discharge rollers 43 for conveying the sheet P after the image fixing operation to the sheet conveyance path 15 (see FIG. 1) are provided downstream (at the left side in FIG. 2) of these separating mechanisms 50.

In this fixing device 20, the sheet P is conveyed by the fixing roller 41 and the pressure roller 42 until the leading end thereof reaches the pair of discharge rollers 43 after passing the nip area between the fixing roller 41 and the pressure roller 42. Further, the fixing roller 41, the pressure roller 42 and the pair of discharge rollers 43 are synchronized with each other to convey the sheet P until the trailing end of the sheet P passes the nip area after the leading end of the sheet P reaches the pair of discharge rollers 43. The sheet P is conveyed only by the pair of discharge rollers 43 after the trailing end of the sheet P passes the nip area.

Figure 3:
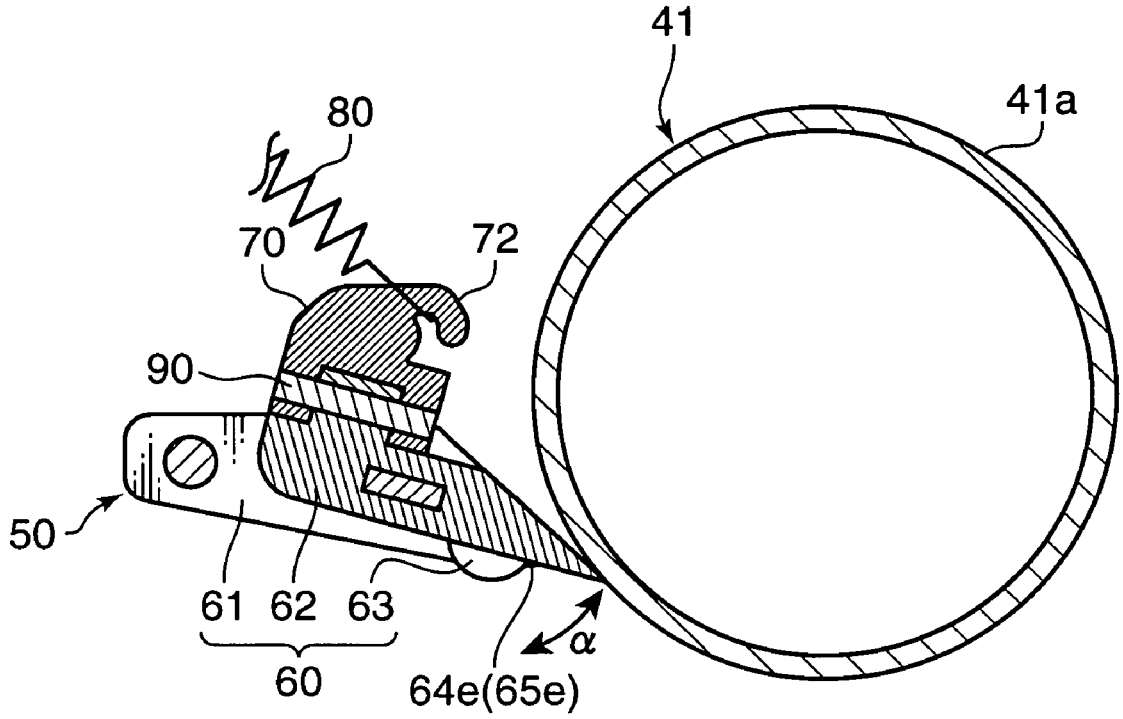
FIG. 3 is a section showing a fixing roller and a separating mechanism of the first fixing device.

Each separating mechanism 50 has a function of suppressing the sheet P from winding around the outer circumferential surface of the fixing roller 41 and includes a separating claw unit 60, a supporting member 70, a tension coil spring 80 and a coupling pin 90 (see FIG. 3) as shown in FIGS. 2 and 3. It should be noted that the separating claw unit 60 is one example of a "claw member", and the tension coil spring 80 is one example of a "biasing member".

The separating claw unit 60 has a function of separating the sheet P from the fixing roller 41 and includes a holder member 61, a claw piece 62 and a pair of roller members 63.

Figure 5:
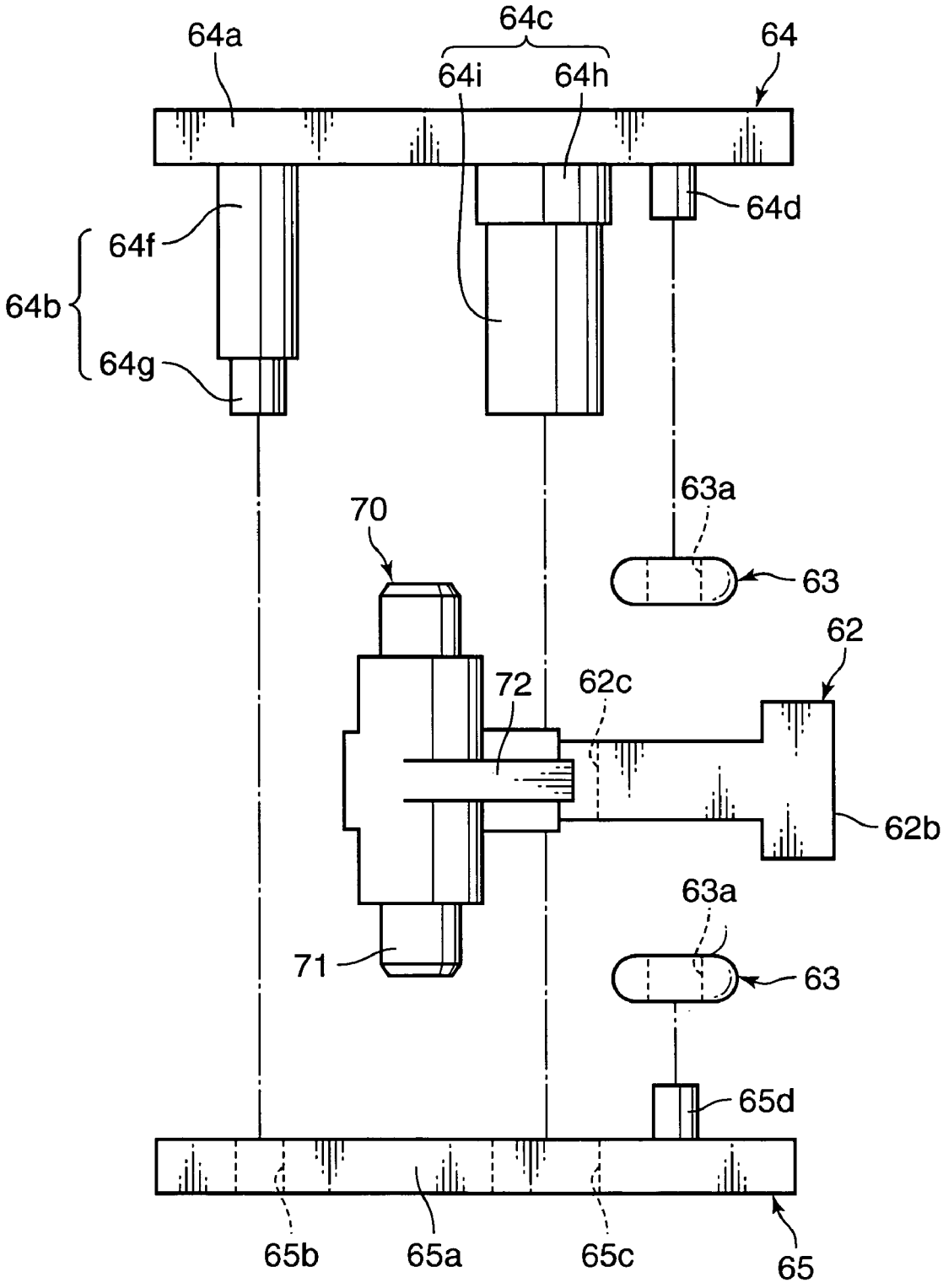
FIG. 5 is a plan view showing an exploded state of the separating mechanism of the first fixing device.

As shown in FIG. 2, the holder member 61 is so disposed as not to touch the fixing roller 41 and so shaped as to be able to fixedly hold the claw piece 62 while enclosing the claw piece 62 and the roller members 63. This holder member 61 includes a male holder 64 having a male structure and a female holder 65 having a female structure as shown in FIG. 5.

The male holder 64 is comprised of a side plate 64*a*; a holder width defining portion 64*b* formed on a surface of the side plate 64*a* facing the female holder 65; a claw fixing portion 64*c*, a supporting shaft portion 64*d* and a guiding portion 64*e* (see FIG. 3) provided at a bottom part of an upstream side of the side plate 64*a* with respect to a sheet conveyance path.

Further, the female holder 65 is comprised of a side plate 65*a*; an insertion hole 65*b* and a press-in hole 65*c* formed at positions of the side plate 65*a* respectively corresponding to the holder width defining portion 64*b* and the claw fixing portion 64*c* of the male holder 64, a supporting shaft portion 65*d* formed on a surface of the side plate 65*a* facing the male holder 64; and a guiding portion 65*e* (see FIG. 3) provided at a bottom part of an upstream side of the side plate 65*a* with respect to the conveyance path.

The holder width defining portion 64*b* is provided to define the width (vertical dimension in the plane of FIG. 4) of the holder member by defining an interval between the respective holders 64, 65. This holder width defining portion 64*b* is comprised of a cylindrical base portion 64*f*, and an inserting portion 64*g* insertable into the insertion hole 65*b* of the female holder 65 and having a diameter smaller than the base portion 64*f*. By the contact of the base portion 64*f* of the holder width defining portion 64*b* with the side plate 65*a* of the female holder 65, the side plates 64*a*, 65*a* are opposed to each other while being spaced apart by a distance equal to the longitudinal length of the base portion 64*f*.

Figure 4:
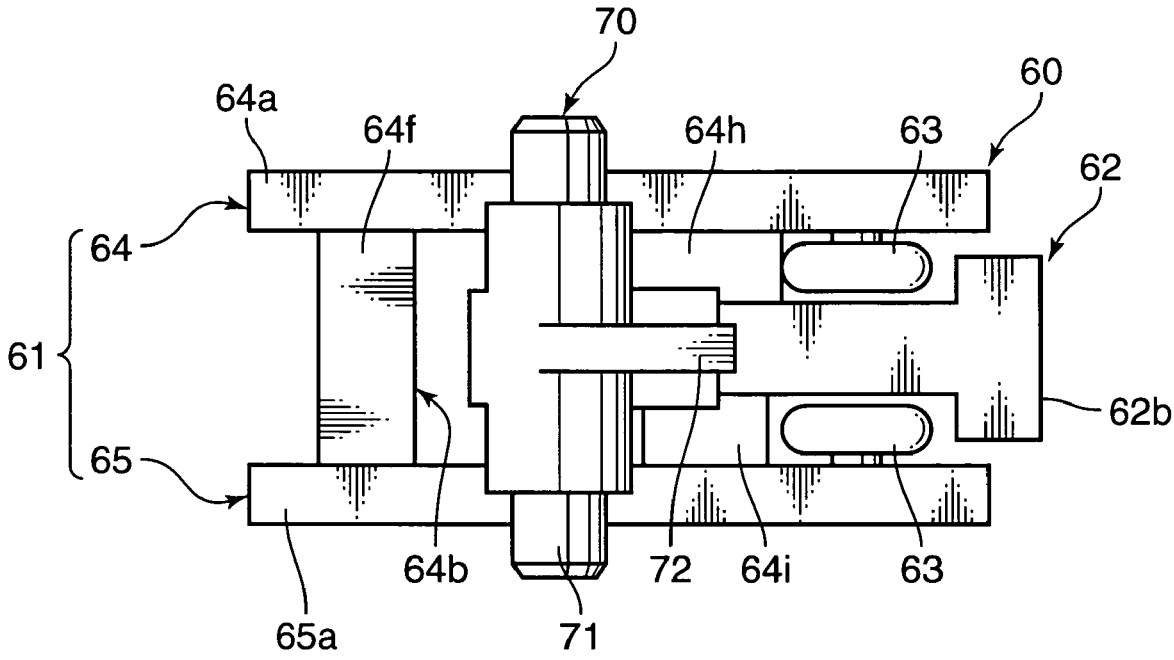
FIG. 4 is a plan view showing a construction of the separating mechanism of the first fixing device.

The claw fixing portion 64*c* is provided to fixedly hold the claw piece 62 between the respective holders 64 and 65. This claw fixing portion 64*c* extends in such a direction as to bridge the side plates 64*a*, 65*a* arranged in parallel, and is comprised of a base portion 64*h* having a rectangular cross section and a press-in portion 64*i* to be successively inserted into an opening 62*c* of the claw piece 62 to be described later and the press-in hole 65*c* of the female holder 65 and having a cross section one size smaller than that of the base portion 64*h*. The contact of the base portion 64*h* of the claw fixing portion 64*c* with the side surface of the claw piece 62 restrains the claw piece 62 from moving toward the side plate 64*a* of the male holder 64 longer than a specified distance. The claw piece 62 pressed into the press-in portion 64*i* while having the position thereof defined by the base portion 64*h* of the claw fixing portion 64*c* is located at a substantially middle position between the side plates 64*a* and 65*a* as shown in FIG. 4.

The supporting shaft portions 64*d*, 65*d* are arranged to face each other at the opposite sides of the claw piece 62, and rotatably hold the roller members 63 thereon. These supporting shaft portions 64*d*, 65*d* project from the corresponding side plates 64*a*, 65*a* to such extents as not to touch the claw piece 62. The guiding portions 64*e*, 65*e* are provided to smoothly guide the leading end of the sheet P to the roller members 63 on a sheet conveyance path between the claw piece 62 and the roller members 63.

Figure 6:
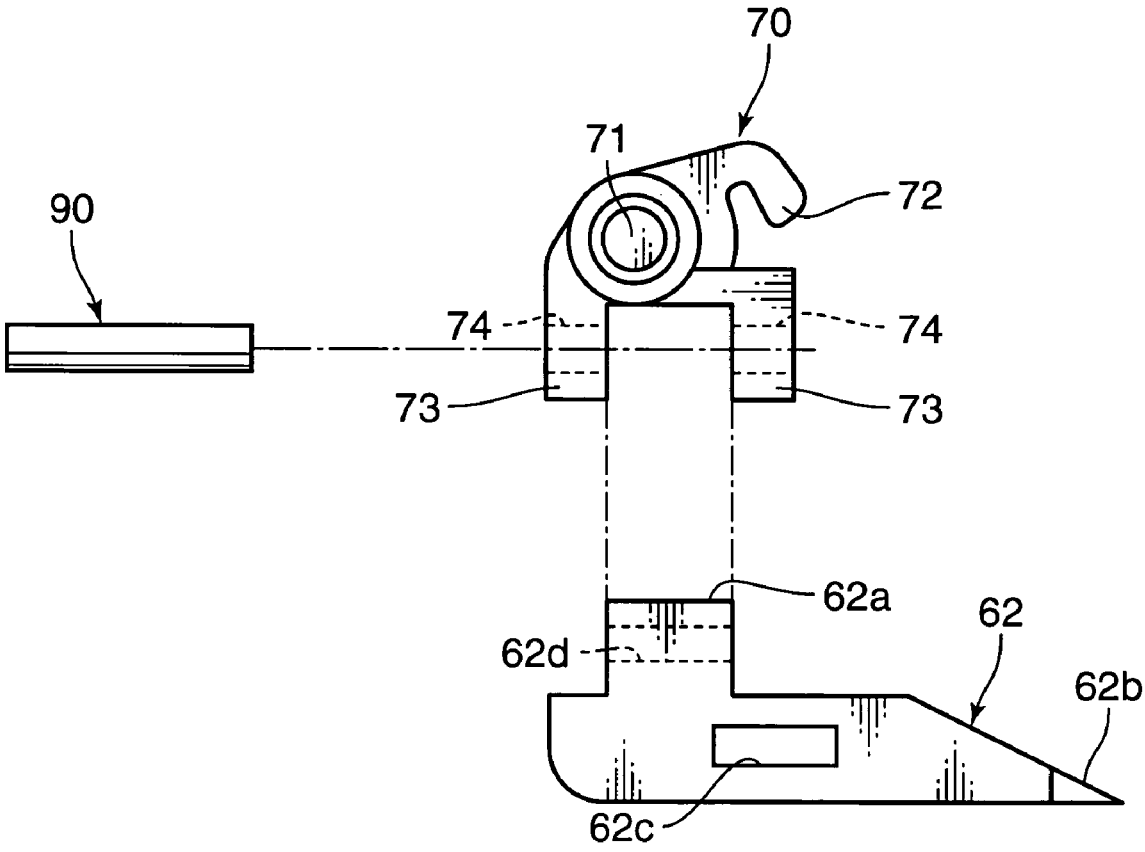
FIG. 6 is an exploded plan view of a coupling construction for coupling a claw member of a separating claw unit and a supporting member of the first fixing device.

As shown in FIG. 6, the claw piece 62 includes a coupling portion 62*a* in the form of a projection formed at a top part of the claw piece 62, an end claw portion 62*b* in the form of a flat plate formed at the right end of the claw piece 62, and the opening 62*c* having a rectangular front view and formed at a substantially middle position of the claw piece 62.

The coupling portion 62*a* is formed with a pin press-in hole 62*d* transversely penetrating the coupling portion 62*a* in FIG. 6. The claw piece 62 is coupled to the supporting member 70 via the coupling pin 90 pressed into this pin press-in hole 62*d*.

The end claw portion 62*b* is formed to have an acute-angled tip in vertical section, and projects outward from an upstream end of the holder member 63 with respect to the sheet conveyance path in an assembled state of the separating claw unit 60. Further, the end claw portion 62*b* is in contact with the outer circumferential surface of the fixing roller 41 by a biasing force of the tension coil spring 80 at a position at a specified distance from a downstream end (nip area exit) of a nip area with respect to a conveyance direction with the separating mechanism 50 mounted in the housing 30.

As described above, the opening 62*c* is for fixedly holding the claw piece 62 on the holder member 61 by having the press-in portion 64*i* of the claw fixing portion 64*c* pressed thereinto.

A pair of roller members 63 are rotatably held on the holder member 61 by having the supporting shaft portions 64*d*, 65*d* inserted into shaft holes 63*a* thereof, and are arranged at the opposite sides of the claw piece 62 between the side plates 64*a*, 65*a*. As shown in FIG. 4, the roller members 63 are held on the corresponding supporting shaft portions 64*d*, 65*d* with specified plays defined to the claw piece 62 in projecting directions of the supporting shaft portions 64*d*, 65*d* so as to be movable away from the claw piece 62. Further, the roller members 63 are formed such that the outer circumferential surfaces thereof are partially exposed outward from the bottom end of the holder member 61 while being held on the holder member 61.

The supporting member 70 has a function of supporting the separating claw unit 60 to pivot in directions about two axes in order to constantly hold the end claw portion 62*b* of the claw piece 62 of the separating claw unit 60 in close contact with the outer circumferential surface of the fixing roller 41. The supporting member 70 includes a shaft portion 71, a hook portion 72 and a pair of coupling pieces 73.

The shaft portion 71 is mounted at a specified position in the housing 30 with the central axis thereof held substantially in parallel with the central axis of the fixing roller 41. Thus, the supporting member 70 is pivotable in directions (directions a in FIG. 3: correspond to "first directions") about an axis substantially in parallel with the central axis of the fixing roller 41.

The hook portion 72 is for mounting one end of the tension coil spring 80.

The coupling pieces 73 are opposed to each other while being transversely spaced apart by a specified distance in FIG. 6, and are formed with pin insertion holes 74 through which the coupling pin 90 is insertable. An interval between these coupling pieces 73 is set to be slightly longer than a transverse length of the coupling portion 62*a* of the claw piece 62.

In this embodiment, the coupling portion 62*a* of the claw piece 62 is fitted between a pair of coupling pieces 73 of the supporting member 70, and the coupling pin 90 is inserted into the pin insertion hole 74 of the supporting member 70 and the pin press-in hole 62*d* of the claw piece 62. In this way, the separating claw unit 60 is coupled to the supporting member 70 via the coupling pin 90 arranged substantially normal to the fixing roller 41. In this coupled state, the separating claw unit 60 is pivotable in directions (directions β in FIG. 7: corresponding to "second directions") about an axis substantially normal to the central axis of the fixing roller 41.

As shown in FIG. 2, the other end of the tension coil spring 80 is attached to an engaging portion 31 formed in the housing 30 of the fixing device 20. In this way, the end claw portion 62*b* of the claw piece 62 is biased in a counterclockwise direction in FIG. 6 about the shaft portion 71 of the supporting member 70 so as to come into contact with the outer circumferential surface of the fixing roller 41.

Figure 7:
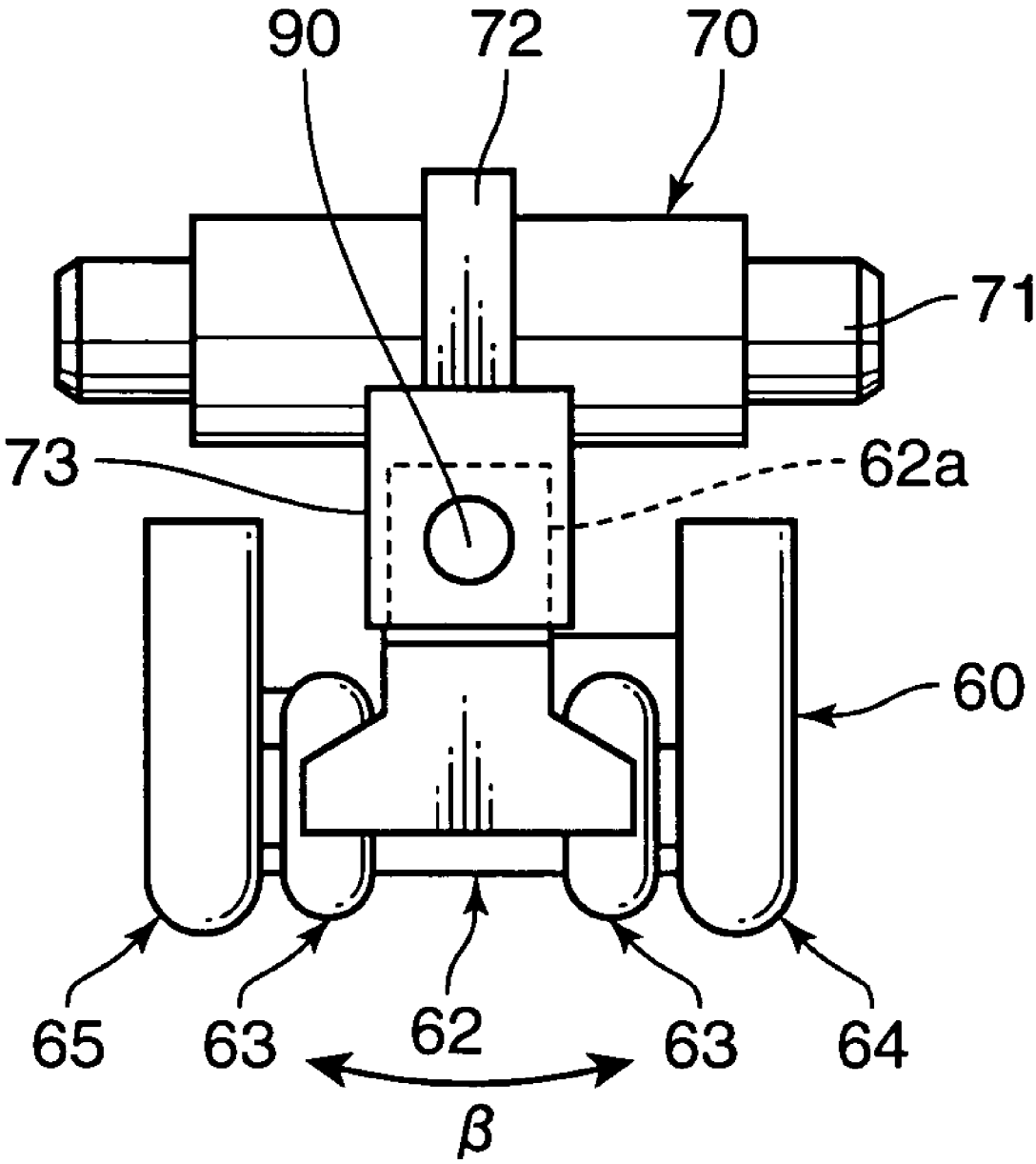
FIG. 7 is a right side view of the separating claw unit and the supporting member of the first fixing device.

In the separating mechanism 50 constructed as above, the end claw portion 62*b* of the claw piece 62 is in contact with the outer circumferential surface of the fixing roller 41 by a biasing force of the tension coil spring 80, the separating claw unit 60 pivots in the directions β of FIG. 7 about the coupling pin 90 relative to the supporting member 70, and the supporting member 70 pivots, together with the separating claw unit 60, in the directions α of FIG. 3 about the shaft portion 71 relative to the housing 30.

As described above, the separating claw unit 60 biased toward the fixing roller 41 is freely movable in directions about two axes in the separating mechanism 50 of this embodiment. By employing such a construction, even if only one side of the separating claw unit 60 is held in contact with the outer circumferential surface of the fixing roller 41, for example, due to the dimensional tolerance or the like of the components, the separating claw unit 60 can quickly pivot in such a direction as to correct the posture thereof according to the biasing force of the tension coil spring 80, wherefore the separating claw unit 60 can be constantly held in contact (close contact) with the outer circumferential surface of the fixing roller 41 at a uniform pressure. Since this can increase a contact area of the separating claw unit 60 with the outer circumferential surface of the fixing roller 41, a contact pressure of the separating claw unit 60 with the fixing roller 41 per unit area can be reduced. Accordingly, the abrasion of the outer circumferential surface of the fixing roller 41 caused by the contact with the separating claw unit 60 can be sufficiently suppressed, wherefore an occurrence of image deterioration can be sufficiently suppressed.

Further, if only one side of the separating claw unit 60 is held in contact with the fixing roller 41, the separating claw unit 60 can quickly pivot in the direction about the coupling pin 90 substantially normal to the central axis of the fixing roller 41 to securely correct the posture of the separating claw unit 60. Therefore, the separating claw unit 60 can be securely held in close contact with the outer circumferential surface of the fixing roller 41.

Furthermore, the supporting member 70 can be caused to pivot in the direction about the shaft portion 71 parallel to the central axis of the fixing roller 41 relative to the housing 30 while the separating claw unit 60 is caused to pivot in the direction about the coupling pin 90 substantially normal to the central axis of the fixing roller 41 relative to the supporting member 70. Therefore, the separating claw unit 60 can easily make free movements in directions about two different axes without using a complicated mechanism.

The first embodiment described above is illustrative, but not restrictive in all points and changes can be made within the scope as claimed and within the meaning and scope of equivalents.

For example, the present invention is applied to the fixing device 20 provided in the printer 1 in the above embodiment, but it is also applicable to other fixing devices provided in image forming apparatuses such as copiers, facsimile machines and composite machines thereof other than printers.

In the foregoing embodiment, the separating claw unit 60 pivotably supported on the supporting member 70 is comprised of the holder member 61, the claw piece 62 and the pair of roller members 63. However, the holder member 61 and the roller members 63 can be suitably omitted and the separating claw unit may be comprised only of the claw piece 62.

In this embodiment is shown an example in which the separating claw unit 60 is caused to make pivoting movements in directions about two different axes by causing the supporting member 70 to pivot in the directions α about the shaft portion 71 relative to the housing 30 and causing the separating claw unit 60 to pivot in the directions β about the coupling pin 90 relative to the supporting member 70. However, the present invention is not limited to this. For example, a coupling mechanism including a coupling pin may be provided between the supporting member 70 and the separating claw unit 60 to cause the separating claw unit 60 to pivot also in directions γ in addition to the directions β relative to the supporting member 70, so that the separating claw unit 60 may be caused to make pivoting movements in directions about three different axes. It should be noted that the third directions are, for example, those about an axis normal to both the shaft portion 71 and the coupling pin 90 (normal to the plane of FIG. 4).

Figure 8:
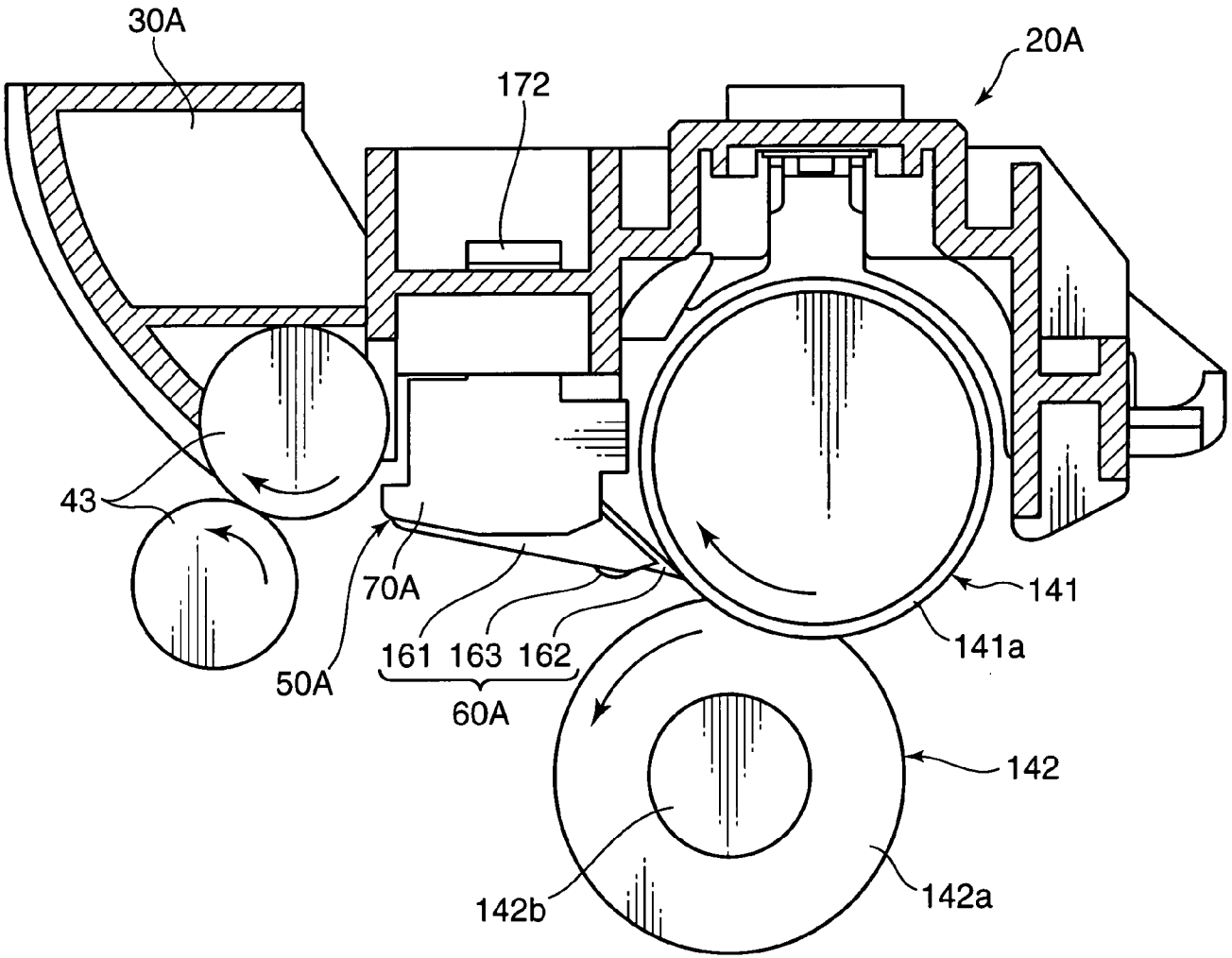
FIG. 8 is a front view showing a second fixing device of the embodiment shown in FIG. 1.

Next, a second embodiment of the present invention is described. FIG. 8 is a front view showing one embodiment of another fixing device 20A installed in the printer 1 shown in FIG. 1. Further, FIGS. 9 to 13 are diagrams showing the construction of a separating mechanism of the fixing device 20A shown in FIG. 8.

As shown in FIG. 8, the fixing device 20A of the second embodiment is constructed such that a fixing (heating) roller 141 capable of evolving heat and a pressure (pressing) roller 141 disposed below the fixing roller 141 to have the outer circumferential surface thereof face that of the fixing roller 141 are arranged in a housing 30A as an apparatus main body. A sheet P after an image transferring operation (see FIG. 1) is heated by the fixing roller 141 to fix a toner image fixed thereto by passing a nip area between the fixing roller 141 rotating clockwise and the pressure roller 142 driven to rotate counterclockwise.

This fixing roller 141 is comprised of an outer tubular element 141*a* formed by coating the outer circumferential surface of a metallic tubular element with a specified material, and a halogen lamp or a like heat source (not shown) mounted in the outer tubular element 141*a*. An unillustrated ring gear is fixed to one end of this outer tubular element 141*a*. The driving rotation of a motor (not shown) disposed at a specified position outside the housing 30A is transmitted to the ring gear via a gear mechanism or the like, whereby the outer tubular element 141*a* is drivingly rotated about a central axis thereof.

The pressure roller 142 is comprised of a tubular roller main body 142*a*, and a roller shaft 142*b* arranged concentrically with the roller main body 142*a* and penetrating end walls of the roller main body 142*a*. This pressure roller 142 is pressed against the outer circumferential surface of the outer tubular element 141*a* of the fixing roller 141 in the nip area, thereby being driven to rotate by the fixing roller 141.

In the fixing device 20A, a plurality of (four in this embodiment) separating mechanisms 50A are arranged at specified intervals along a direction of the longitudinal axis of the fixing roller 141 at a specified part of the housing 30A. A pair of discharge rollers 43 for conveying the sheet P after the image fixing operation to a sheet conveyance path 15 (see FIG. 1) are provided downstream (at the left side in FIG. 8) of these separating mechanisms 50A. It should be noted that the separating mechanisms 50A are one example of "separating means".

In this fixing device 20A, the sheet P is conveyed by the fixing roller 141 and the pressure roller 142 until the leading end thereof reaches the pair of discharge rollers 43 after passing the nip area between the fixing roller 141 and the pressure roller 142. Further, the fixing roller 141, the pressure roller 142 and the pair of discharge rollers 43 are synchronized with each other to convey the sheet P until the trailing end of the sheet P passes the nip area after the leading end of the sheet P reaches the pair of discharge rollers 43. The sheet P is conveyed only by the pair of discharge rollers 43 after the trailing end of the sheet P passes the nip area.

Figure 9:
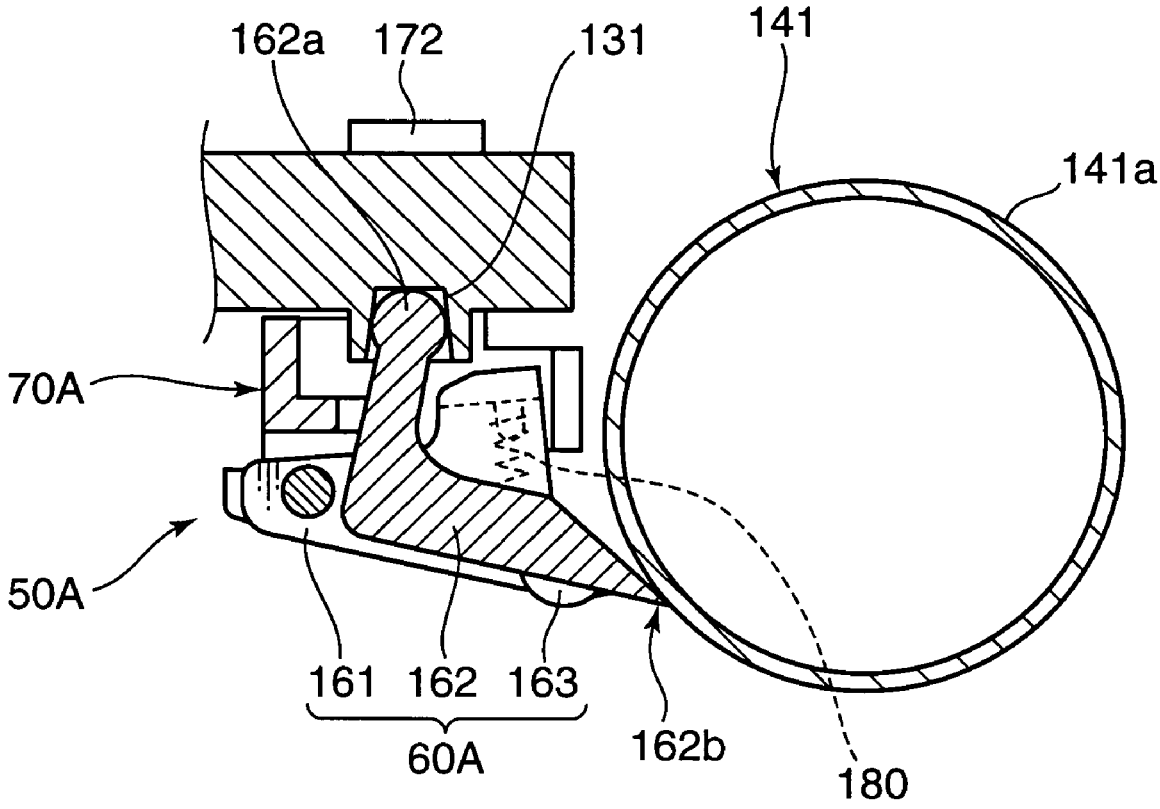
FIG. 9 is a section showing a separating mechanism and a fixing roller of the second fixing device.

Each separating mechanism 50A has a function of separating the sheet P trying to wind around, the outer circumferential surface of the fixing roller 141 from this outer circumferential surface, and includes a separating claw unit 60A, a supporting member 70A, a pair of compression coil springs 180 (see FIG. 9). It should be noted that the separating claw unit 60A is one example of a "claw member", and the compression coil springs 180 are one example of a "coil spring" and a "biasing member".

Figure 10:
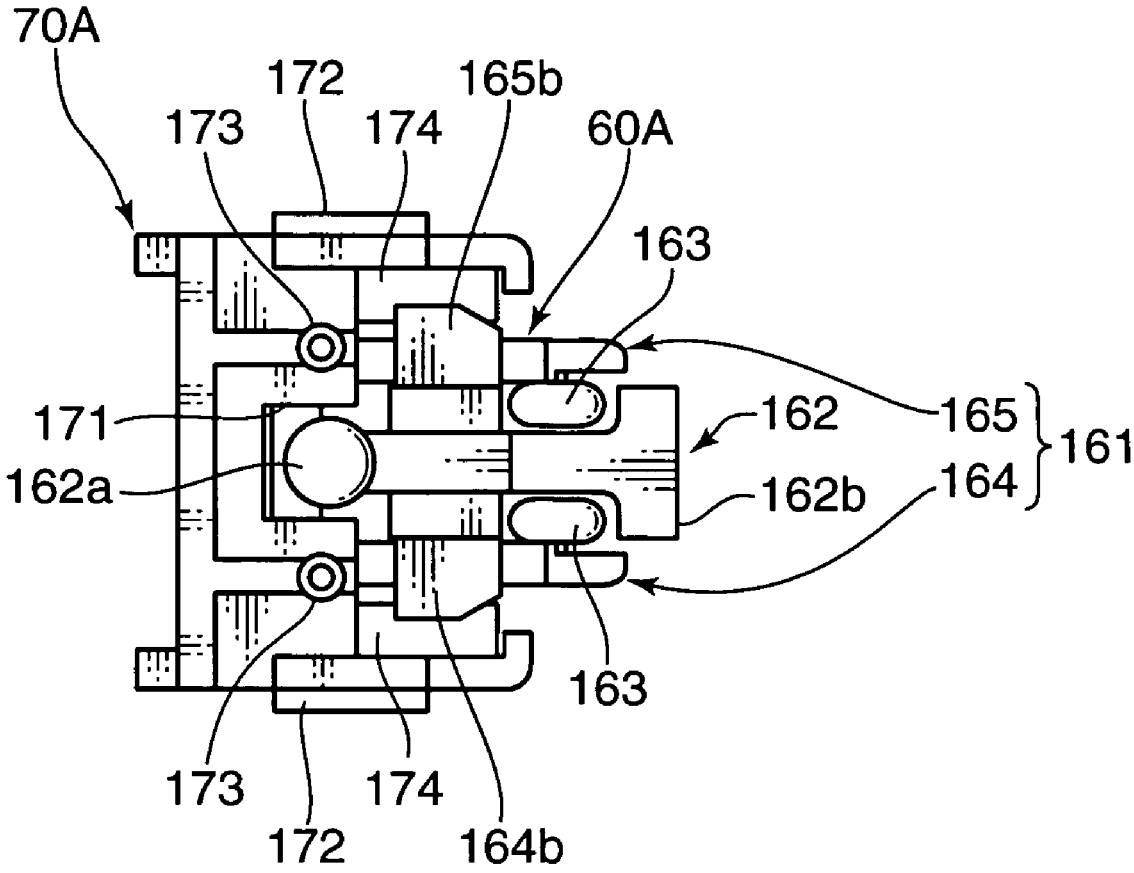
FIG. 10 is a plan view showing a construction of the separating mechanism of the second fixing device.

The separating claw unit 60A includes a holder member 161, a claw piece 162 substantially L-shaped in front view and a pair of roller members 163 (see FIG. 10).

The holder member 161 fixedly holds the claw piece 162 and is so disposed as not to touch the fixing roller 141 as shown in FIG. 8 and is so shaped as to be able to enclose the claw piece 162 and the roller members 163. This holder member 161 includes a male holder 164 having a male structure and a female holder 165 having a female structure.

Figure 11A:
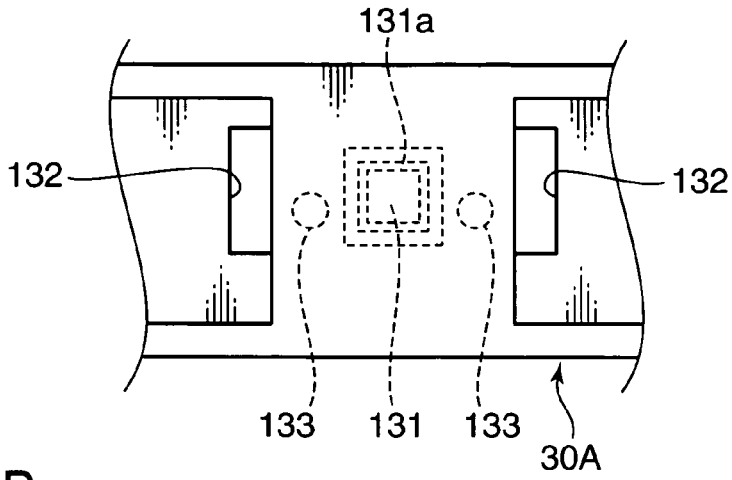
Figure 11B:
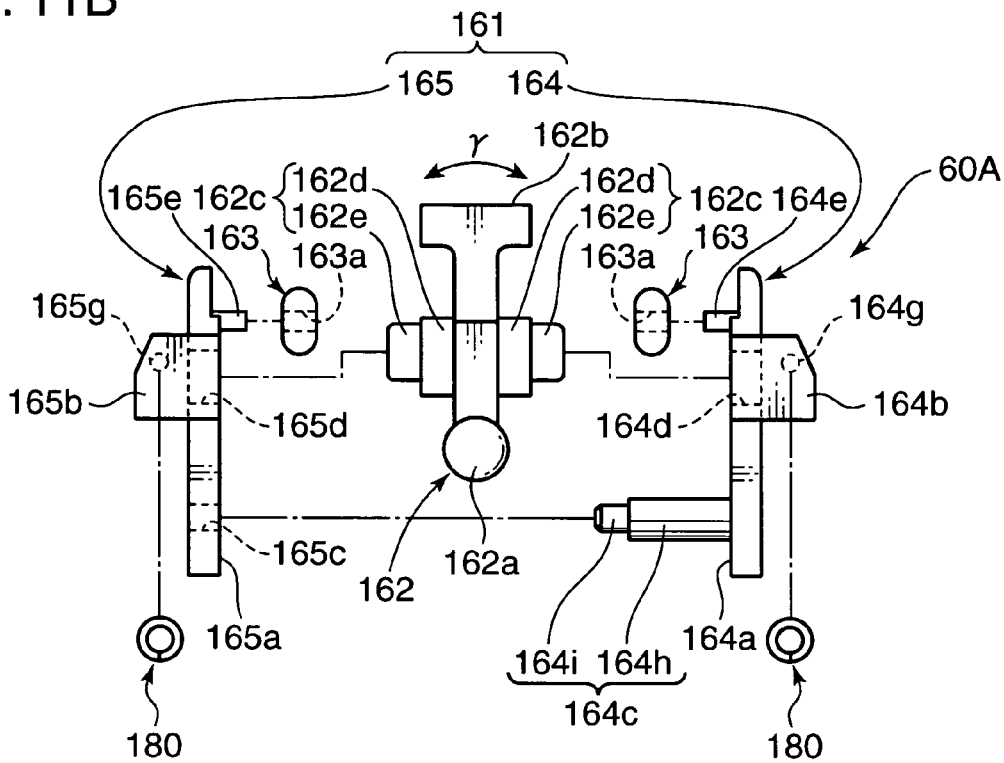
Figure 11C:
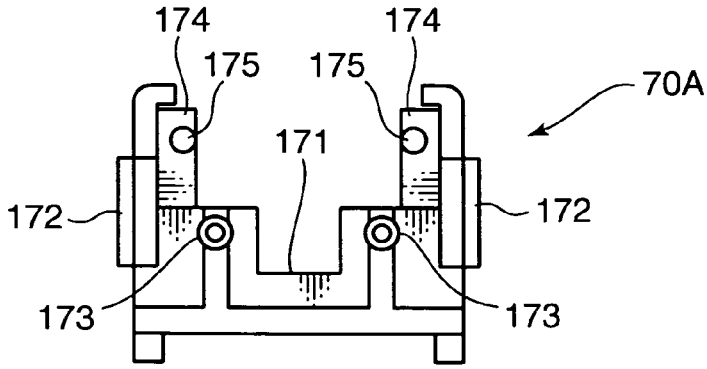
Figure 12A:
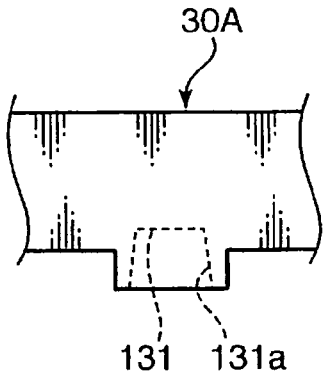
Figure 12B:
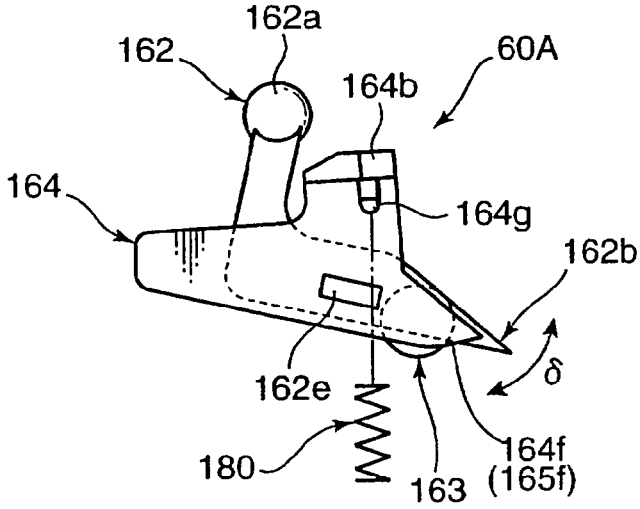
Figure 12C:
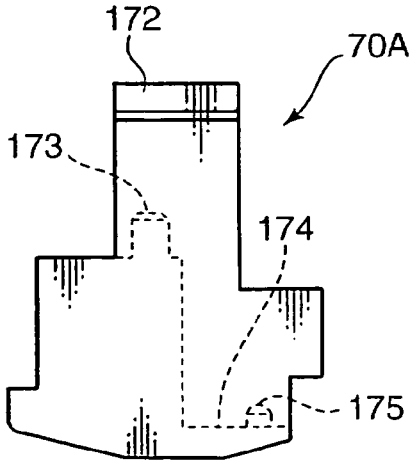
Figure 13A:
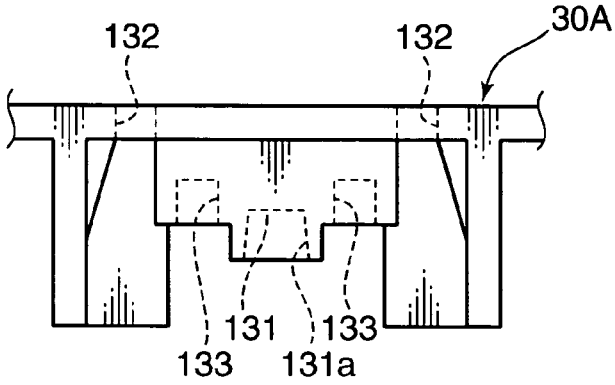
Figure 13B:
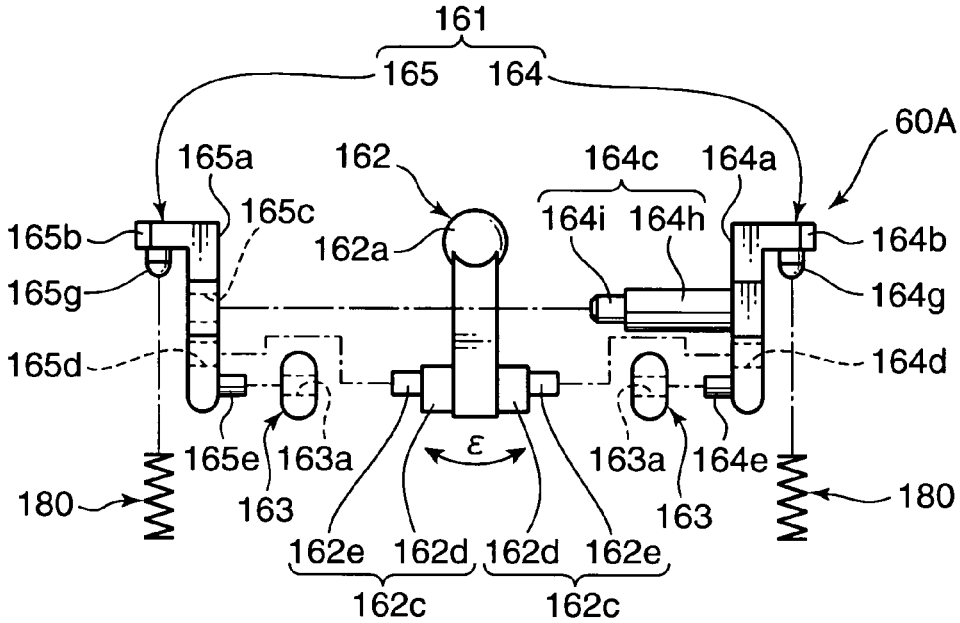
Figure 13C:
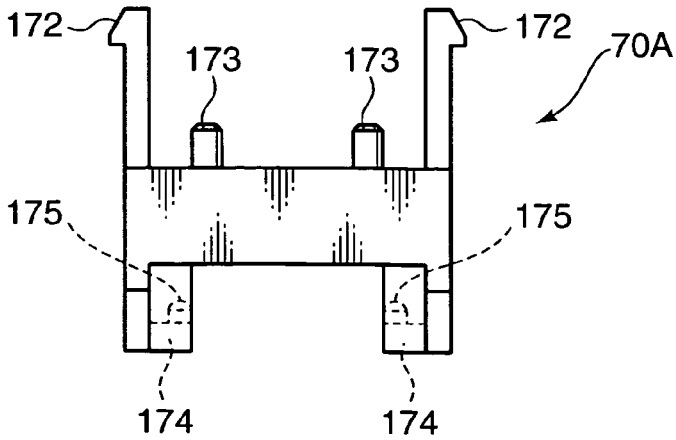

As shown in FIGS. 11B, 12B, 13B, the male holder 164 includes a side plate 164*a* having a laterally long front view; a spring seat 164*b* formed at an upper part of the side plate 164*a*; a holder width defining portion 164*c* formed on a surface of the side plate 164*a* facing the female holder 165; a press-in hole 164*d* formed at a position of the side plate 164*a* corresponding to one movement preventing portion 162*c* of the claw piece 162 to be described later; a supporting shaft portion 164*e* formed on the surface of the side plate 164*a* facing the female holder 165; and a guiding portion 164*f* (see FIG. 12B) provided at a bottom part of an upstream side of the side plate 164*a* with respect to a conveyance path.

The female holder 165 includes a side plate 165*a* having a laterally long front view; a spring seat 165*b* formed at an upper part of the side plate 165*a*; an insertion hole 165*c* formed at a position of the side plate 165*a* corresponding to the holder width defining portion 164*c* of the male holder 164; a press-in hole 165*d* formed at a position of the side plate 165*a* corresponding to the other movement preventing portion 162*c* of the claw piece 162; a supporting shaft portion 165*e* formed on a surface of the side plate 165*a* facing the male holder 164; and a guiding portion 165*f* (see FIG. 12B) provided at a bottom part of an upstream side of the side plate 165*a* with respect to the conveyance path.

The upper ends of the compression coil springs 180 are brought into contact with the spring seats 164*b*, 165*b*, and bosses 164*g*, 165*g* engageable with the upper ends of the compression coil springs 180 are formed on the lower surfaces of the spring seats 164*b*, 165*b*. These spring seats 164*b*, 165*b* are located substantially in the middle between a pivotal supporting portion 162*a* and an end claw portion 162*b* of the claw piece 162 to be described later of the claw piece 162 to be described later when the separating claw unit 60A is assembled.

The holder width defining portion 164*c* is provided to define the width of the holder member 161 by defining an interval between the respective holders 164 and 165. This holder width defining portion 164*c* is comprised of a cylindrical base portion 164*h*, and an inserting portion 164*i* insertable into the insertion hole 165*c* of the female holder 165 and having a diameter smaller than the base portion 164*h*. By the contact of the base portion 164*h* of the holder width defining portion 164*c* with the side plate 165*a* of the female holder 165, the side plates 164*a*, 165*a* are held while being spaced apart by a distance equal to the longitudinal length of the base portion 164*h*.

The supporting shaft portions 164*e*, 165*e* are arranged to face each other, and rotatably hold the roller members 163 thereon. These supporting shaft portions 164*e*, 165*e* project from the corresponding side plates 164*a*, 165*a* to such extents as not to touch the claw piece 162.

The guiding portions 164*f*, 165*f* are provided to smoothly guide the leading end of a sheet P to the roller members 163 on the conveyance path of the sheet P between the claw piece 162 and the roller members 163.

The claw piece 162 is held in contact with the outer circumferential surface of the fixing roller 141 and includes the pivotal supporting portion 162*a*, the end claw portion 162*b* and a pair of movement preventing portions 162*c*.

The pivotal supporting portion 162*a* has a substantially spherical shape, and is so held in a recess-shaped pivot receiving portion 131 (see FIGS. 11A, 12A and 13A) formed in the housing 30A as to make pivoting movements when the separating mechanism 50A is mounted in the housing 30A. The pivot receiving portion 131 has a substantially square horizontal section and the opening thereof is gradually widened from the bottom thereof. The pivotal supporting portion 162*a* functions as a supporting point when the end claw portion 162*b* of the separating claw unit 60A freely moves in many directions (pivoting movements about many axis directions: see arrows $\gamma$, $\delta$, $\epsilon$ in FIGS. 11B, 12B, 13B). It should be noted that the pivotal supporting portion 162*a* may be formed to have, for example, a conical or pyramid shape other than the substantially spherical shape.

The end claw portion 162*b* is at a specified distance from the pivotal supporting portion 162*a*, in the form of a flat plate, and formed to have an acute-angled leading end in vertical section. This end claw portion 162*b* is held in contact with the outer circumferential surface of the fixing roller 141 in such a state as to be pivotable about many axis directions with the pivotal supporting portion 162*a* as the supporting point by mounting the separating mechanism 50A in the housing 30A as described above.

Each movement preventing portion 162*c* is for fixing the claw piece 162 to the holder member 161 and is comprised of a base portion 162*d* having a rectangular cross section and a press-in portion 162*e* having a cross section one size smaller than that of the base portion 162*d*. The base portions 162*d* are held in contact with the side plates 164*a*, 165*a* of the respective holders 164, 165, thereby preventing the claw piece 162 from moving between the respective holders 164, 165. The claw piece 162 having the position defined by the base portions 162*d* of the movement preventing portions 162*c* in this way is located at a substantially middle position between the side plates 164*a* and 165*a*.

This claw piece 162 is arranged at the substantially middle position between the side plates 164*a*, 165*a* of the respective holders 164, 165 such that the end claw portion 162*b* projects outward from an upstream end of the holder member 161 with respect to the conveyance path. Further, by biasing forces of the pair of compression coil springs 180, the end claw portion 162*b* is held in contact with the outer circumferential surface of the fixing roller 141 at a position spaced apart by a specified distance from a downstream end of the nip area (nip area exit) with respect to a conveyance direction.

A pair of roller members 163 are rotatably held on the holder member 161 by having the supporting shaft portions 164*e*, 165*e* inserted into shaft holes 163*a* thereof, and arranged at the opposite sides of the claw piece 162 between the side plates 164*a*, 165*a*. As shown in FIG. 10, the roller members 163 are held on the supporting shaft portions 164*e*, 165*e* with specified plays defined to the claw piece 162 in projecting directions of the supporting shaft portions 164*e*, 165*e* so as to be movable away from the claw piece 162.

Further, the roller members 163 are formed such that the outer circumferential surfaces thereof are partially exposed outward from the bottom end of the holder member 161 while being held on the holder member 161.

The supporting member 70A has a function of supporting the separating claw unit 60A pivotably about many axis directions in order to constantly hold the claw piece 162 of the separating claw unit 60A in close contact with the outer circumferential surface of the fixing roller 141. The supporting member 70A is comprised of a recessed portion 171, a pair of hook portions 172, a pair of positioning projections 173 and a pair of spring seats 174.

The recessed portion 171 is formed by recessing the supporting member 70A at a specified position to have a rectangular plan view so that the supporting member 70A does not interfere with the claw piece 162 of the separating claw unit 60A.

The hook portions 172 are provided to fix the supporting member 70A to the housing 30A by being inserted into and engaged with hook engaging holes 132 formed in the housing 30A.

The positioning projections 173 function to position the supporting member 70A by being inserted into positioning recesses 133 formed in the housing 30A when the supporting member 70A is mounted into the housing 30A.

The bottom ends of the compression coil springs 180 are brought into contact with the spring seats 174, and bosses 175 engageable with the bottom ends of the compression coil springs 180 are formed on the upper surfaces of the spring seats 174.

The pair of compression coil springs 180 are arranged along the longitudinal axis of the fixing roller 141 (see FIG. 9) at positions symmetrical with respect to a plane passing the pivotal supporting portion 162*a* (see FIGS. 11B and 13B). The compression coil springs 180 span between the spring seats 174 of the supporting member 70A and the spring seats 164*b* (165*b*) of the separating claw unit 60A and are supported while biasing the separating claw unit 60A toward the outer circumferential surface of the fixing roller 141 so that the claw piece 162 presses the fixing roller 141. This pair of compression coil springs 180 are so compressed as to hold the separating claw unit 60A in contact with both the housing 30A and the outer circumferential surface of the fixing roller 141 by the biasing forces of the compression coil springs 180 when the supporting member 70A is mounted into the housing 30A.

In the separating mechanism 50A constructed as above, both ends (upper and lower ends in FIG. 10) of the end claw portion 162*b* of the claw piece 162 of the separating claw unit 60A are held in contact with the outer circumferential surface of the fixing roller 141 substantially at the same pressing forces by the biasing forces of the pair of compression coil springs 180. For example, if only one side of the separating claw unit 60A is in contact with the outer circumferential surface of the fixing roller 141, the separating claw unit 60A pivots about many axis directions (see arrows $\gamma$, $\delta$, $\epsilon$ in FIGS. 11B, 12B, 13B) with the pivotal supporting portion 162*a* held in the recessed pivot receiving portion 131 of the housing 30A in such a manner as to make pivoting movements as the supporting point while yielding to the biasing forces of the pair of compression coil springs 180.

As described above, the separating claw unit 60A biased toward the fixing roller 141 is so constructed as to be pivotable about many axis directions in this embodiment. This enables the separating claw unit 60A to quickly pivot in such a direction as to correct the posture thereof while yielding to the biasing forces of the compression coil springs 180 even if only one side thereof is in contact with the outer circumferential surface of the fixing roller 141, for example, due to the dimensional tolerance or the like of components. Thus, the separating claw unit 60A can be constantly held in contact (close contact) with the outer circumferential surface of the fixing roller 141 at a uniform pressure. Since this can increase a contact area of the separating claw unit 60A with the outer circumferential surface of the fixing roller 141, a contact pressure per unit area given to the fixing roller 141 by the separating claw unit 60A can be reduced. As a result, the abrasion of the outer circumferential surface of the fixing roller 141 caused by the contact with the separating claw unit 60A can be sufficiently suppressed, wherefore an occurrence of image deterioration can be sufficiently suppressed.

By employing such a construction as to support the separating claw unit 60A on the supporting member 70A via the compression coil springs 180, the separating claw unit 60A can be supported by the compression coil springs 180 while being biased toward the fixing roller 141 by the compression coil springs 180. Accordingly, the compression coil springs 180 elongate or contract to absorb an external force acting on the separating claw unit 60A, whereby the separating claw unit 60A can easily pivot in conformity with the external force.

Further, the claw piece 162 of the separating claw unit 60A is comprised of the pivotal supporting portion 162*a* functioning as the supporting point and the end claw portion 162*b* provided at the specified distance from the pivotal supporting portion 162*a*. Further, parts (spring seats 164*b*, 165*b* of the respective holders 164, 165) between the pivotal supporting portion 162*a* and the end claw portion 162*b* of the claw piece 162 are respectively biased by the pair of compression coil springs 180. This enables the end claw portion 162 in contact with the outer circumferential surface of the fixing roller 141 to easily pivot with the pivotal supporting portion 162*a* as the supporting point.

Furthermore, the pivotal supporting portion 162*a* of the claw piece 162 can be caused to securely function as the supporting point by being held into contact with the housing 30A by the biasing forces of the compression coil springs 180. Accordingly, the end claw portion 162*b* can be caused to pivot about many axis directions by letting the biasing forces of the compression coil springs 180 act on the end claw portion 162*b* of the claw piece 162.

Further, the substantially spherical pivotal supporting portion 162*a* can easily make pivoting movements by being held in the recess-shaped pivot receiving portion 131 formed in the housing 30A. Therefore, the end claw portion 162*b* of the claw piece 162 can be caused to easily pivot about many axis directions.

Furthermore, the pivot receiving portion 131 is formed to have a substantially square horizontal section and to be gradually widened from the bottom thereof toward the opening. In this way, the pivot receiving portion 131 comes to possess a surrounding wall 131*a* inclined to be gradually widened from the bottom toward the opening, wherefore such a force as to constantly locate the substantially spherical pivotal supporting portion 162*a* at a specified position (see FIG. 9) substantially in the center of the pivot receiving portion 131 can be let to continuously act on the pivotal supporting portion 162*a*. Hence, the pivotal supporting portion 162*a* can be caused to stably make rotary movements (pivoting movements) since the pivotal supporting portion 162*a* can be rotatably held at the specified position.

Further, the pair of compression coil springs 180 are arranged at the positions symmetrical with respect to a plane passing the pivotal supporting portion 162*a* and perpendicularly intersecting the longitudinal direction of the fixing roller 141. Thus, both ends (upper and lower ends in FIG. 10) of the end claw portion 162*b* freely movable in many directions with the pivotal supporting portion 162*a* as the supporting point can be held in contact with the outer circumferential surface of the fixing roller 141, whereby two independent biasing forces can be exerted in a well-balanced manner to the separating claw unit 60A by the pair of compression coil springs 180. Accordingly, even if the above biasing forces are weak, there is no likelihood that only one side of the claw piece 162 is held in contact with the outer circumferential surface of the fixing roller 141. Therefore, the separating claw unit 60A having the end claw portion 162*b* in the form of a relatively wide flat plate can be held in close contact with the outer circumferential surface of the fixing roller 141 with weak pressing forces.

The second embodiment described above is illustrative, but not restrictive in all aspects, and changes can be made within the scope as claimed and within the meaning and scope of equivalents.

For example, the present invention is applied to the fixing device 20A provided in the printer 1 in the above embodiment, but it is also applicable to other fixing devices provided in image forming apparatuses such as copiers, facsimile machines and composite machines thereof other than printers.

In the above embodiment, the supporting member 70A pivotably supporting the separating claw unit 60A is separately provided and mounted on the housing 30A. However, the present invention is not limited thereto and the separating claw unit 60A may be supported by a supporting portion formed to be integral to the housing 30A. In such a case, the housing 30A corresponds to a "supporting member".

Further, the separating claw unit 60A comprised of the holder member 161, the claw piece 162 and the pair of roller members 163 is used in the above embodiment. However, the present invention is not limited thereto, and the holder member 161 and the roller members 163 can be suitably omitted and the separating claw unit may be comprised only of the claw member. In such a case, it is preferable to form spring seats having bosses at suitable portions of the claw member and to directly bias the claw member, for example, by means of the compression coil springs 180.

Further, in the above embodiment, the pivot receiving portion 131 is formed to have a substantially square horizontal section and to be gradually widened from the bottom toward the opening. However, the present invention is not limited thereto, and the pivot receiving portion 131 may be formed to have a polygonal horizontal section other than the square one and to be gradually widened from the bottom toward the opening or may be formed to have a conical shape or a semispherical shape having an inner diameter slightly larger than the outer diameter of the substantially spherical pivotal supporting portion 162*a*.

Furthermore, in the above embodiment, the pair of compression coil springs 180 are mounted to span between the spring seats 174 of the supporting member 70A and the spring seats 164*b* (165*b*) of the separating claw unit 60A, thereby biasing a part of the separating claw unit 60A closer to the fixing roller 141 than the pivotal supporting portion 162*a* by the pair of compression coil springs 180. However, the present invention is not limited thereto, and the part of the separating claw unit 60A closer to the fixing roller 141 than the pivotal supporting portion 162*a* may be so biased as to be pulled up, for example, by a pair of tension coil springs each having one end thereof attached to the housing 30A. Alternatively, the separating claw unit 60A may be supported by a supporting mechanism and the part thereof closer to the fixing roller 141 than the pivotal supporting portion 162*a* may be so biased as to be pushed down by a pair of compression coil springs.

The aforementioned specific embodiments mainly embrace features of the inventions having the following constructions.

A fixing device comprises a fixing roller for fixing a toner image transferred on a sheet to the sheet and a separating mechanism for separating the sheet from the fixing roller, the separating mechanism including a claw member having a tip portion held in contact with the outer circumferential surface of the fixing roller for separating the sheet from the fixing roller, a supporting member pivotably supporting the claw member, and a biasing member for biasing the claw member toward the outer circumferential surface of the fixing roller so that the tip portion of the claw member presses the fixing roller.

According to this fixing device, by constructing the claw member biased toward the fixing roller to be freely movable, the claw member can quickly pivot in such a direction as to correct the posture thereof while yielding to a biasing force of the biasing member even if only one side of the claw member is in contact with the outer circumferential surface of the fixing roller, for example, due to the dimensional tolerance or the like of components. Thus, the claw member can be constantly held in contact (close contact) with the outer circumferential surface of the fixing roller at a uniform pressure. Since this can increase a contact area of the claw member and the outer circumferential surface of the fixing roller, a contact pressure per unit area of the claw member with the fixing roller can be reduced.

Accordingly, the abrasion of the outer circumferential surface of the fixing roller caused by the contact with the separating claw unit can be sufficiently suppressed, with the result that an occurrence of image deterioration can be sufficiently suppressed.

The supporting member can support the claw member in such a manner as to be freely movable in directions about two axes. This enables the supporting member to be simply constructed.

In such a case, the claw member preferably pivots in first directions about an axis substantially parallel to the central axis of the fixing roller and in second directions about an axis substantially normal to the central axis of the fixing roller. With such a construction, if only one side of the claw member is in contact with the fixing roller, the claw member can quickly pivot in the second direction about the axis substantially normal to the central axis of the fixing roller to correct the posture thereof, wherefore the claw member can be securely held in close contact with the outer circumferential surface of the fixing roller.

In the above construction, a housing on which the supporting member is mounted is preferably further provided, the supporting member pivots in the first directions relative to the housing together with the claw member and the claw member pivots in the second directions relative to the supporting member. With this construction, the supporting member can pivot in the first directions relative to the housing while the claw member pivots in the second directions relative to the supporting member, wherefore the claw member can be easily freely moved in the directions about two different axes without using a complicated mechanism.

The supporting member may support the claw member freely movably in directions about many axes. With this construction, a degree of freedom in the pivoting movements of the claw member can be improved.

In this construction, the biasing member may span between the supporting member and the claw member and the claw member may be supported on the supporting member via the biasing member. Since this enables the claw member to be supported by the biasing member while being biased toward the fixing roller by the biasing member, the biasing member absorbs an external force acting on the claw member, whereby the claw member can easily pivot according to the external force.

Further, the claw member preferably includes a pivotal supporting portion provided at a position at a specified distance from the tip portion of the claw member held in contact with the outer circumferential surface of the fixing roller and functioning as a supporting point in a pivoting state. With this construction, the tip portion in contact with the outer circumferential surface of the fixing roller can be easily caused to pivot with the pivotal supporting portion as the supporting point.

In such a case, it is particularly preferable that the claw member has an end claw portion at a specified distance from the pivotal supporting portion and held in contact with the outer circumferential surface of the fixing roller and the biasing member biases a part of the claw member between the pivotal supporting portion and the end claw portion.

In this construction, it is preferable that a housing on which the supporting member is mounted is further provided and the pivotal supporting portion of the claw member is held in contact with the housing by the biasing force of the biasing member. Since this can cause the pivotal supporting portion to securely function as the supporting point, the end claw portion can be freely moved in directions about many axes by causing the biasing force of the biasing member to act on the end claw portion of the claw member.

Here, it is preferable that the pivotal supporting portion is formed to have a substantially spherical shape and the housing includes a pivot receiving portion in the form of a recess capable of holding the pivotal supporting portion. Since the pivotal supporting portion can be caused to easily make rotary movements (pivoting movements) by holding the substantially spherical pivotal supporting portion in the recess-shaped pivot receiving portion formed in the housing, the end claw portion of the claw member can be easily freely moved in directions about many axes.

In such a case, the pivot receiving portion is preferably in the form of a recess gradually widened from the bottom thereof toward the opening thereof. With this construction, the pivot receiving portion comes to possess a surrounding wall inclined to be gradually widened from the bottom toward the opening. Thus, such a force as to constantly locate the substantially spherical pivotal supporting portion at a specified position substantially in the center of the pivot receiving portion can be let to continuously act on the pivotal supporting portion. Hence, the pivotal supporting portion can be caused to stably make rotary movements (pivoting movements) since the pivotal supporting portion can be rotatably held at the specified position.

In this construction, the biasing member preferably includes a pair of coil springs arranged at positions symmetrical with respect to a plane passing the pivotal supporting portion and perpendicularly intersecting the central axis of the fixing roller. With this construction, two independent biasing forces can be caused to act on the claw member in a well-balanced manner from the pair of coil springs in order to respectively bring the opposite ends of the end claw portion freely movable in the directions about many axes with the pivotal supporting portion as the supporting point and spaced apart along the direction of the central axis of the fixing roller into contact with the outer circumferential surface of the fixing roller. Accordingly, even if the biasing forces are weak, there is no likelihood that only one side of the claw member is held in contact with the outer circumferential surface of the fixing roller.

In the above construction, a rotary member rotatably arranged at a position downstream of the end claw portion of the claw member with respect to a conveyance path for the sheet is preferably further provided to guide the sheet separated from the fixing roller toward a downstream side of the conveyance path while being rotated. With this construction, the sheet can be more smoothly conveyed by the rotary member.

In such a case, it is preferable to provide a guiding portion for guiding the sheet to the rotary member on the conveyance path between the end claw portion of the claw member and the rotary member. Such a guiding portion smoothes the conveyance of the sheet between the end claw portion of the claw member and the rotary member.

An image forming apparatus comprises an image forming unit for transferring a toner image to a sheet, and a fixing device for fixing the toner image transferred in the image forming unit to the sheet by heating, the fixing device including a fixing roller for fixing the toner image transferred on the sheet to the sheet and a separating mechanism for separating the sheet from the fixing roller, the separating mechanism including a claw member having a tip portion held in contact with the outer circumferential surface of the fixing roller for separating the sheet from the fixing roller, a supporting member pivotably supporting the claw member, and a biasing member for biasing the claw member toward the outer circumferential surface of the fixing roller so that the tip portion of the claw member presses the fixing roller.

In this construction, the supporting member may support the claw member in such a manner as to be freely movable in directions about two axes. Alternatively, the supporting member may support the claw member in such a manner as to be freely movable in directions about many axes.

This application is based on patent application Nos. 2005-337403, 2005-343243 and 2006-141416 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device, comprising:

a fixing roller for fixing a toner image transferred on a sheet to the sheet; and a separating mechanism for separating the sheet from the fixing roller, the separating mechanism including:

a claw member having a tip portion held in contact with an outer circumferential surface of the fixing roller for separating the sheet from the fixing roller;

a supporting member pivotably supporting the claw member so that the claw member is freely pivotable about at least two non-parallel axes; and a biasing member for biasing the claw member toward the outer circumferential surface of the fixing roller so that the tip portion of the claw member presses the fixing roller.

2. A fixing device according to claim 1, wherein the claw member pivots in first directions about an axis substantially parallel to the central axis of the fixing roller and in second directions about an axis substantially normal to the central axis of the fixing roller.

3. A fixing device according to claim 2, further comprising a housing on which the supporting member is mounted, wherein the supporting member pivots in the first directions relative to the housing together with the claw member and the claw member pivots in the second directions relative to the supporting member.

4. A fixing device according to claim 1, wherein the supporting member supports the claw member in such a manner as to be freely movable in directions about many axes.

5. A fixing device according to claim 4, wherein:

the biasing member spans between the supporting member and the claw member and the claw member is supported on the supporting member via the biasing member.

6. A fixing device according to claim 4, wherein the claw member includes a pivotal supporting portion provided at a position at a specified distance from the tip portion held in contact with the outer circumferential surface of the fixing roller and functioning as a supporting point in a pivoting state.

7. A fixing device according to claim 6, wherein:

the claw member includes an end claw portion provided at a specified distance from the pivotal supporting portion and held in contact with the outer circumferential surface of the fixing roller, and the biasing member biases a part of the claw member between the pivotal supporting portion and the end claw portion.

8. A fixing device according to claim 6, further comprising a housing on which the supporting member is mounted, wherein the pivotal supporting portion of the claw member is held in contact with the housing by a biasing force of the biasing member.

9. A fixing device according to claim 8, wherein:

the pivotal supporting portion has a substantially spherical shape, and the housing includes a pivot receiving portion in the form of a recess capable of holding the pivotal supporting portion.

10. A fixing device according to claim 9, wherein the pivot receiving portion is in the form of a recess gradually widened from the bottom thereof toward the opening thereof.

11. A fixing device according to claim 6, wherein the biasing member includes a pair of coil springs arranged at positions symmetrical with respect to a plane passing the pivotal supporting portion and perpendicularly intersecting the central axis of the fixing roller.

12. A fixing device according to claim 1, further comprising a rotary member rotatably arranged at a position downstream of the tip portion of the claw member with respect to a conveyance path for the sheet and adapted to guide the sheet separated from the fixing roller toward a downstream side of the conveyance path while being rotated.

13. A fixing device according to claim 12, further comprising a guiding portion for guiding the sheet to the rotary member on the conveyance path between the tip portion of the claw member and the rotary member.

14. An image forming apparatus, comprising:

an image forming unit for transferring a toner image to a sheet; and a fixing device for fixing the toner image transferred in the image forming unit to the sheet by heating, the fixing device including:

a fixing roller for fixing the toner image transferred on the sheet to the sheet; and a separating mechanism for separating the sheet from the fixing roller, the separating mechanism including a claw member having a tip portion held in contact with the outer circumferential surface of the fixing roller for separating the sheet from the fixing roller, a supporting member pivotably supporting the claw member so that the claw member is freely pivotable about at least two non-parallel axes, and a biasing member for biasing the claw member toward the outer circumferential surface of the fixing roller so that the tip portion of the claw member presses the fixing roller.

15. An image forming apparatus according to claim 14, wherein the supporting member supports the claw member in such a manner as to be freely movable in directions about many axes.

* * * * *